US011268510B2

(12) United States Patent
Lee et al.

(10) Patent No.: US 11,268,510 B2
(45) Date of Patent: Mar. 8, 2022

(54) FLUID COMPRESSOR HAVING DISCHARGE PORT AND VALVE

(71) Applicant: LG Electronics Inc., Seoul (KR)

(72) Inventors: Jaeha Lee, Seoul (KR); Jinho Kim, Seoul (KR); Sungyong Ahn, Seoul (KR); Yoonsung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 254 days.

(21) Appl. No.: 16/526,421

(22) Filed: Jul. 30, 2019

(65) Prior Publication Data

US 2020/0032797 A1 Jan. 30, 2020

(30) Foreign Application Priority Data

Jul. 30, 2018 (KR) ..... 10-2018-0088430

(51) Int. Cl.

| | |
|---|---|
| ***F04C 15/06*** | (2006.01) |
| ***F04C 29/12*** | (2006.01) |
| ***F04C 18/02*** | (2006.01) |
| ***F04B 39/10*** | (2006.01) |
| ***F04C 23/00*** | (2006.01) |

(52) U.S. Cl.

CPC ..... *F04C 18/0215* (2013.01); *F04B 39/1073* (2013.01); *F04C 18/0269* (2013.01); *F04C 23/008* (2013.01); *F04C 29/128* (2013.01); *F04C 2240/30* (2013.01)

(58) Field of Classification Search

CPC ..... F04C 18/0215; F04C 18/0253; F04C 18/0269; F04C 23/008; F04C 29/123; F04C 29/128; F04C 15/068; F04B 39/1073; F01C 1/0253; F01C 1/0261

See application file for complete search history.

(56) References Cited

U.S. PATENT DOCUMENTS 157,791 A * 12/1874 Cameron ..... F16K 15/038 137/512.1
939,549 A * 11/1909 Reineking ..... F16K 15/16 137/856

(Continued)

FOREIGN PATENT DOCUMENTS

JP 2002250280 9/2002
JP 2004301104 10/2004

(Continued)

OTHER PUBLICATIONS

Korean Notice of Allowance in Korean Application No. 10-2018-0088430, dated Nov. 29, 2019, 1 page (with English translation).

*Primary Examiner* — Deming Wan
(74) *Attorney, Agent, or Firm* — Fish & Richardson P.C.

(57) ABSTRACT

A fluid compressor is provided. The fluid compressor includes a case including an inlet configured to introduce fluid to be compressed, a compression unit including a compression chamber configured to compress the fluid introduced into the case, and a discharge port configured to discharge the compressed fluid to the outside of the compression chamber, a motor configured to drive the compression unit, and a valve configured to open and close the discharge port. The valve includes a fastening portion coupled to the compression unit to be spaced a first distance from the discharge port.

20 Claims, 4 Drawing Sheets

(56) References Cited

U.S. PATENT DOCUMENTS

| | | | | |
|---|---|---|---|---|
| 5,203,686 | A * | 4/1993 | Scheldorf | F04C 29/128 137/851 |
| 2006/0065012 | A1* | 3/2006 | Kudo | F04C 29/026 62/469 |
| 2015/0345493 | A1* | 12/2015 | Lochner | F04C 23/008 418/55.5 |
| 2016/0312783 | A1* | 10/2016 | Tirgovet | F04C 18/34 |

FOREIGN PATENT DOCUMENTS

| | | |
|---|---|---|
| JP | 2013177820 | 9/2013 |
| KR | 1020030074906 | 9/2003 |

* cited by examiner

FLUID COMPRESSOR HAVING DISCHARGE PORT AND VALVE

CROSS-REFERENCE TO RELATED APPLICATION

This application claims priority to Korean Application No. 10-2018-0088430, filed on Jul. 30, 2018, the contents of which are hereby incorporated by reference in their entirety.

BACKGROUND OF THE INVENTION

Field of the Invention

The present disclosure relates to a fluid compressor, and more particularly, to a fluid compressor which reduces noise generated from a valve for opening and closing a discharge port through which compressed fluid is discharged.

Discussion of the Related Art

In general, a fluid compressor includes a compression unit for compressing fluid, and the compression unit may be provided with a valve for opening and closing a discharge port through which compressed fluid is discharged.

For example, International Patent WO 2016/002013 discloses a conventional fluid compressor including a valve.

In the conventional fluid compressor, with one lengthwise end portion of the valve fixed to one surface of a compression unit, one surface of the valve covers the top of a discharge port.

The valve may move elastically to be repeatedly open and closed, each time fluid is compressed in a compression chamber of the compression unit. That is, with one lengthwise end portion of the valve fixed, the other lengthwise end portion of the valve may move continuously in a direction of closing the discharge port and a direction of opening the discharge port.

This conventional fluid compressor generates noise caused by repeated hits of the bottom surface of a free end portion of the valve on one surface of the compression unit during opening and closing of the valve.

That is, because the bottom surface of the valve and the one surface of the compression unit are repeatedly brought into surface contact, the conventional fluid compressor generates relatively large noise.

SUMMARY OF THE INVENTION

Accordingly, the present disclosure is directed to a fluid compressor that substantially obviates one or more problems due to limitations and disadvantages of the related art.

An aspect of the present disclosure is to provide a fluid compressor which reduces noise by bringing a free end portion of a valve and one surface of a compression unit into line contact during opening and closing of the valve.

Another aspect of the present disclosure is to provide a fluid compressor which reduces noise by bringing a valve and a retainer for limiting the displacement of the valve into line contact during opening and closing of the valve.

Another aspect of the present disclosure is to provide a fluid compressor which secures damping force and reduces noise at the same time during opening and closing of a valve by using a retainer formed as a stack of a plurality of plates.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a fluid compressor includes a case including an inlet configured to introduce fluid to be compressed, a compression unit including a compression chamber configured to compress the fluid introduced into the case, and a discharge port configured to discharge the compressed fluid to the outside of the compression chamber, a motor configured to drive the compression unit, and a valve configured to open and close the discharge port. The valve includes a fastening portion coupled to the compression unit to be spaced a first distance from the discharge port.

In an embodiment, the one lengthwise end portion of the valve may be engaged with the one surface of the compression unit by a fastening member penetrating through the one lengthwise end portion of the valve, at a position apart from the discharge port.

To maintain the first distance, a first spacing member may be provided between the one lengthwise end portion of the valve and the one surface of the compression unit. Therefore, noise is generated from line contact between the valve and the one surface of the compression unit during repeated opening and closing of the valve, and thus collision noise may be reduced, compared to noise caused by surface contact.

The valve may extend from the one lengthwise end portion thereof toward the other lengthwise end portion thereof, to overlap with the discharge port over a part of the length of the valve.

The fluid compressor may further include a retainer configured to limit an opening displacement of the valve. The retainer may include one lengthwise end portion engaged with the one surface of the compression unit, to be apart from one surface of the valve along a whole length of the retainer by a predetermined second distance.

Therefore, noise is generated from line contact between the valve and the retainer during repeated opening and closing of the valve, and thus collision noise may be reduced, compared to noise caused by surface contact.

Specifically, the retainer may extend in parallel to the valve. The retainer may be disposed to overlap with the valve over the whole length of the retainer.

The length of the retainer may be smaller than the length of the valve. Therefore, during repeated opening and closing of the valve, a bottom edge of the free end portion of the retainer is brought into line contact with a top surface of the valve, thereby generating less noise than surface contact.

The one lengthwise end portion of the valve and the one lengthwise end portion of the retainer may be engaged with the one surface of the compression unit by a fastening member penetrating through the one lengthwise end portion of the valve and the one lengthwise end portion of the retainer, at a position apart from the discharge port.

To maintain the second distance, a second spacing member is provided between the one lengthwise end portion of the retainer and the one lengthwise end portion of the valve. Because the retainer is formed as a member of a stiffness, the retainer may be kept apart from the valve along the whole length of the retainer by the second distance by the second spacing member.

The other lengthwise end portion of the retainer, which is a free end portion, may be disposed above the top surface of the valve.

In another embodiment, the retainer may be formed as a stack of a plurality of plates. The stacked plates are intended to increase damping efficiency of the retainer, when the valve collides with the retainer.

As the plurality of plates are farther from the valve, the plurality of plates may be formed to be shorter.

Particularly in adjacent plates, a free end portion of a plate relatively far from the valve may be disposed on a top surface of a plate relatively near to the valve.

The plurality of plates may have different stiffnesses. As the plurality of plates are farther from the valve, the plurality of plates may be formed as members of large stiffnesses. Therefore, the plurality of plates may increase damping efficiency.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE INVENTION

Figure 1:
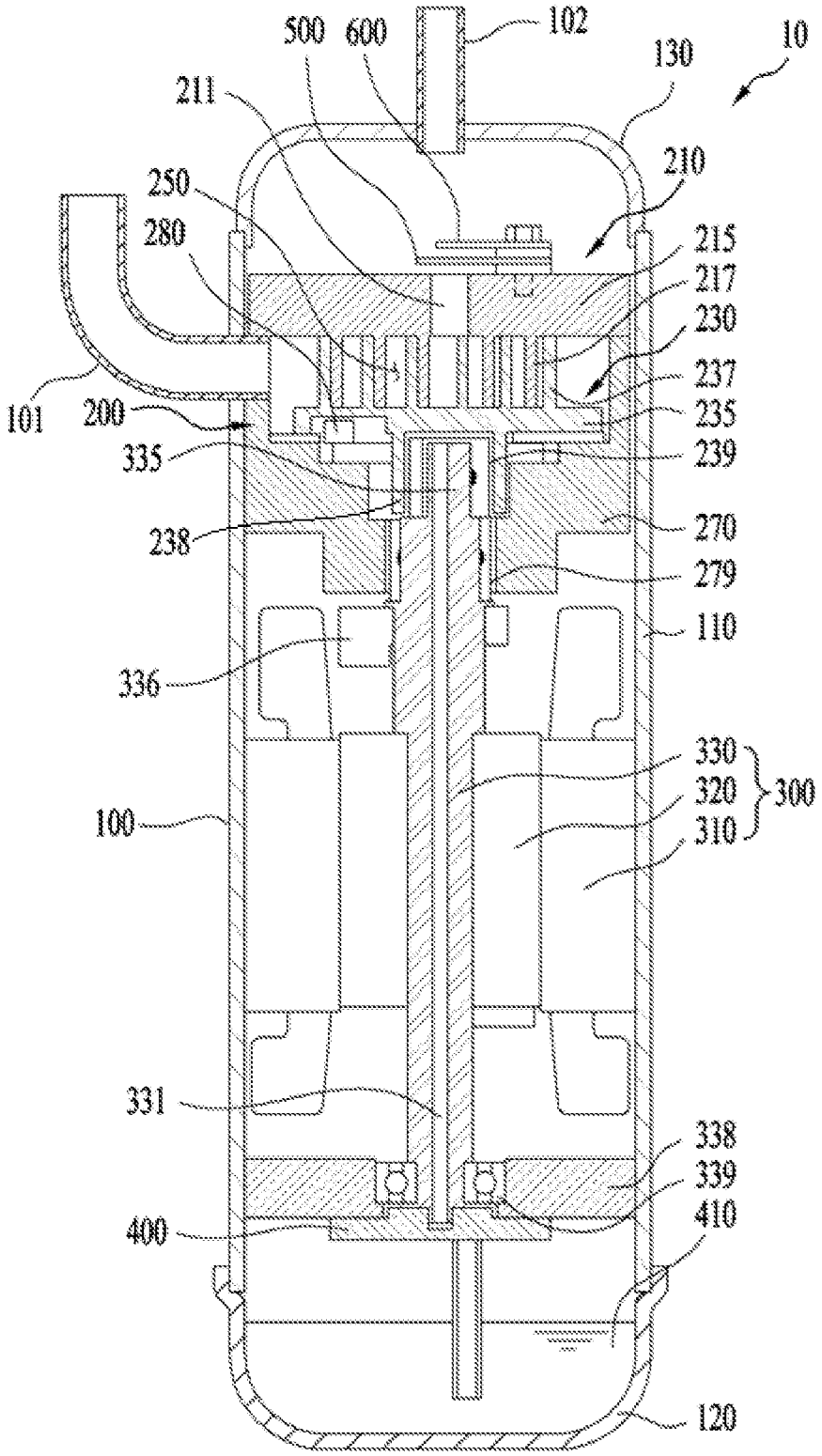
FIG. 1 is a sectional view illustrating an overall structure of a fluid compressor according to the present disclosure.

With reference to the attached drawings, a fluid compressor according to the present disclosure will be described below in detail. The attached drawings, which exemplify the disclosure, are given to describe the disclosure in detail, not limiting the scope and spirit of the disclosure.

Like reference numerals denote the same components throughout the drawings, and a redundant description of components will be avoided herein. For the convenience of description, the size and shape of each component may not be drawn to scale.

FIG. 1 is a sectional view illustrating an overall structure of a fluid compressor according to the present disclosure. With reference to FIG. 1, the overall structure of the fluid compressor will be described. Unless otherwise specified, the fluid compressor of the present disclosure may refer to a scroll compressor that compresses fluid by a fixed scroll and an orbiting scroll. Further, fluid may be gas refrigerant.

Referring to FIG. 1, a fluid compressor 10 according to the present disclosure may include a case 100 forming the outer appearance of the fluid compressor 10, a compression unit 200 disposed inside the case 100, and a motor 300 which drives the compression unit 200.

The case 100 may include an inlet 101 through which fluid to be compressed is introduced, and an outlet 102 through which the fluid compressed by the compression unit 200 is discharged. That is, the fluid to be compressed may be introduced into the case 100 through the inlet 101, and discharged to the outside of the case 100 through the outlet 102.

The case 100 may be sealed except for the inlet 101 and the outlet 102.

The case 100 may include a middle case 110 forming a surrounding side surface thereof, a first case 130 having the outlet 102 and a second case 120 facing the first case. For example, the case 100 may include a lower case 120 defining a lower end thereof, and an upper case 130 defining an upper end thereof. The lower case 120 is sealedly engaged with a bottom end of the middle case 110, and the upper case 130 is sealedly engaged with a top end of the middle case 110.

The inlet 101 may be provided in the middle case 110, and the outlet 102 may be provided in the upper case 130.

The compression unit 200 may include a compression chamber 250 for compressing the fluid introduced into the case 100 and a discharge port 211 for discharging the compressed fluid to the outside of the compression chamber 250.

The compression unit 200 may include a fixed scroll 210 and an orbiting scroll 230. The fixed scroll 210 may be fixedly installed in the case 100, and the orbiting scroll 230 may be installed movably, unlike the fixed scroll 210.

Specifically, the fixed scroll 210 may include a first plate part 215 and a first scroll 217 protruding from one surface of the first plate part 215. The orbiting scroll 230 may include a second plate part 235 and a second scroll 237 protruding from one surface of the second plate part 235.

The first scroll 217 and the second scroll 237 may be meshed with each other. That is, the fixed scroll 210 and the orbiting scroll 230 may be disposed such that the first scroll 217 and the second scroll 237 face each other.

The compression chamber 250 may be provided between the fixed scroll 210 and the orbiting scroll 230. That is, the compression chamber 250 may be provided between the first scroll 217 and the second scroll 237.

The orbiting scroll 230 may be driven by a motor 300. That is, a rotation shaft 330 of the motor 300 may be coupled to the orbiting scroll 230. The fluid may be compressed in the compression chamber 250 by the operation of the orbiting scroll 230.

The discharge port 211 may be provided in the first plate part 215. That is, the discharge port 211 may be formed to penetrate through the first plate part 215, and communicate with the compression chamber 250.

The fixed scroll 210 may be engaged with a main frame 270 fixedly installed inside the case 100. In the illustrated embodiment, the fixed scroll 210 may be engaged with the main frame 270 under the fixed scroll 210. The orbiting scroll 230 may be disposed in a space between the fixed scroll 210 and the main frame 270.

An Oldham ring 280 may be provided at a side of the orbiting scroll 230 to prevent self-rotation of the orbiting scroll 230. Even though the rotation shaft 330 rotates, the orbiting scroll 230 may make an orbiting motion without rotating in view of the Oldham ring 280. The Oldham ring 280 is well-known and thus will not be described in detail herein.

The motor 300 may include a stator 310 fixedly installed in the case 100, a rotor 320 disposed radially to be rotatable inside the stator 310, and the rotation shaft 330 engaged with the rotor 320, radially inside the rotor 320.

The orbiting scroll 230 may be engaged with one lengthwise end portion of the rotation shaft 330. In the illustrated embodiment, the rotation shaft 330 may penetrate through the main frame 270 and be engaged with the orbiting scroll 230. A first bearing 279 may be provided in the main frame 270, to support the rotation shaft 330.

A top end of the rotation shaft 330 penetrating through the main frame 270 may be engaged with the second plate part 235. Therefore, rotational force of the rotation shat 330 may be transferred to the orbiting scroll 230.

An eccentric part 335 may be provided at one lengthwise end portion of the rotation shaft 330, and the orbiting scroll 230 may be engaged with the eccentric part 335. A second bearing 239 may be provided at an engaged portion between the orbiting scroll 230 and the rotation shaft 330. That is, the second bearing 239 may be provided between a foot bearing 238 provided at the orbiting scroll 230 and the eccentric part 335 of the rotation shaft 330.

A balancer 336 may be provided on the rotation shaft 330 or rotor 320, to prevent vibrations caused by the eccentric part 335. For example, the balancer 336 may be engaged with the rotation shaft 330, under the eccentric part 335, and disposed to be eccentric in an opposite direction to the eccentric part 335.

The compressor 10 of the present invention may include a third bearing 339 for supporting the other end of the rotary shaft 330 and a sub-frame 338 for supporting the third bearing 339. For example, the case 100 may include the third bearing 339 for supporting the lower end of the rotation shaft 330 in the longitudinal direction, and a sub-frame 338 for supporting the third bearing 339.

And the oil pump 400 may be provided in the motor in a direction away from the outlet. The oil pump 400 may be coupled to the rotation shaft 330. Specifically, the oil pump 400 may be formed to supply oil in an oil passage 331 which penetrates through the rotation shaft 330 in a length direction.

For example, an oil containing space 410 may be provided inside a lower part of the case 100. That is, the oil containing space 410 may be provided inside the afore-described lower case 120. Oil 410 contained in the oil containing space 410 may be supplied into the oil passage 331 by the oil pump 400. To lubricate a frictional surface and radiate heat from the frictional surface, the oil supplied into the oil passage 331 may be guided to frictional surfaces of the afore-described first, second, and third bearings 279, 239, and 339.

The fluid compressor 10 may further include a valve 500 formed to open and close the afore-described discharge port 211 and a retainer 600 formed to limit the displacement of the valve 500.

For example, the valve 500 may be engaged with one surface 216 of the compression unit 200. The valve 500 may be formed as a member of a predetermined stiffness, and elastically open and close the discharge port 211.

To reduce noise caused by repeated opening and closing of the valve 500, the valve 500 may be disposed apart from the one surface 216 of the compression unit 200 by a predetermined distance.

The retainer 600 may be provided to restrict movement of the valve 500 in a direction away from the discharge port 211. For example, the retainer 600 may be disposed above the valve 500. That is, the valve 500 may be provided between the retainer 600 and the discharge port 211.

With further reference to other drawings, the configurations of the valve 500 and the retainer 600 will be described in detail.

Figure 2:
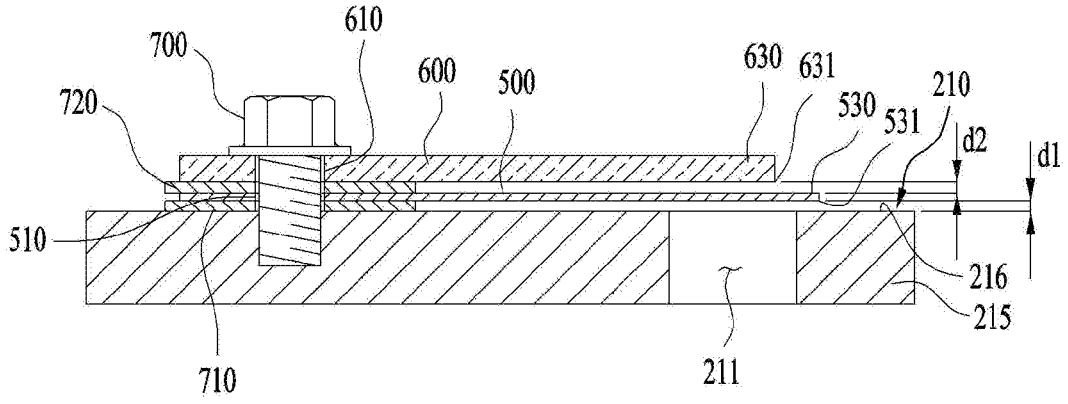
FIG. 2 is a diagram illustrating a first embodiment of a valve for opening and closing a discharge port, and a retainer.

FIG. 2 is a diagram illustrating a first embodiment of a valve for opening and closing a discharge port, and a retainer. Specifically, FIG. 2 is a side sectional view of the valve and the retainer according to the first embodiment.

Figure 3A:
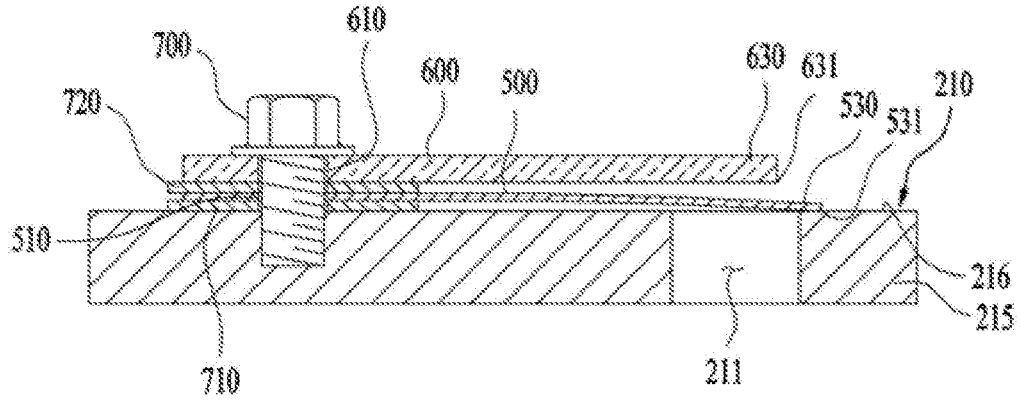
FIGS. 3A and 3B are diagrams illustrating opening and closing of the valve according to the first embodiment.
Figure 3B:
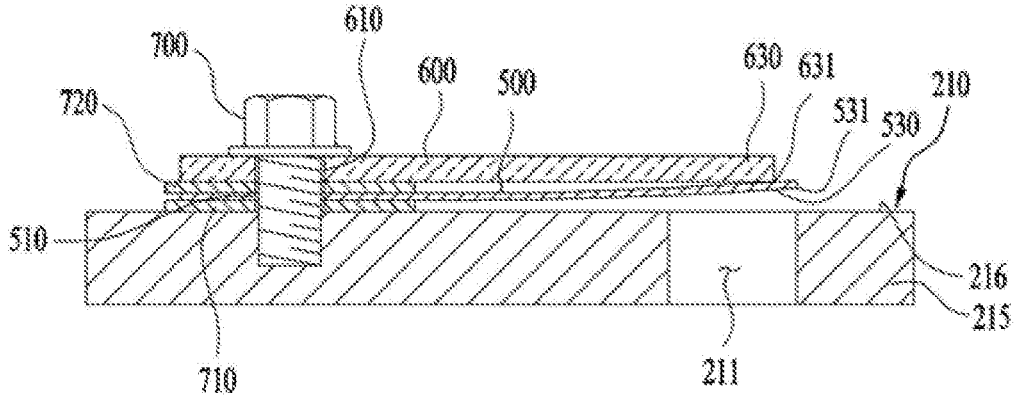

FIGS. 3A and 3B are diagrams illustrating opening and closing of the valve according to the first embodiment. Specifically, FIG. 3A illustrates opening of the valve according to the first embodiment, and FIG. 3B illustrates closing of the valve according to the first embodiment.

Referring to FIG. 2, while the fluid compressor is operating, the valve 500 may elastically move the longitudinal direction of the discharge port 211 based on the internal pressure and external pressure of the afore-described compression chamber.

That is, because one lengthwise end portion of the valve 500 is fixed, a free end portion of the valve 500 may repeatedly open and close the discharge port 211, while moving the longitudinal direction of the discharge port 211.

During opening and closing of the valve 500, noise may be generated due to collision between the free end portion of the valve 500 and the one surface of the compression unit and collision between the free end portion of the valve 500 and the one surface of the retainer 600. To reduce the collision noise, the valve 500 and the retainer 600 of the present disclosure may be configured as follows.

The valve 500 may be disposed apart from the one surface 216 of the compression unit along the whole length of the valve 500 by a predetermined first distance d1. The one surface 216 of the compression unit may be the same as one surface of the fixed scroll, the one surface of the fixed scroll, one side surface of the first plate part 215, and the top surface of the first plate part 215.

That is, while the fluid compression 10 is inoperative, the valve 500 may be kept apart from the one surface 216 of the compression unit along the whole length of the valve 500 by the predetermined first distance d1.

Specifically, with the valve 500 apart from the one surface 216 of the compression unit by the predetermined first distance d1, the valve 500 may be engaged with the one surface 216 of the compression unit. The valve 500 may include a fastening portion 510 coupled to one side 216 of the compression portion. The fastening part 510 may be disposed at one end in the longitudinal direction of the valve 500. The fastening portion 510 can be seen as a fixed end of the valve 500. a valve free-end 530 forming the free end of the valve 500 may be formed to have a size sufficient to cover the discharge port 211.

Therefore, during closing of the valve 500, the valve edge 531 corresponding to the edge of the valve free-end 530 can be brought into contact with the one side surface 216 of the compression portion (see FIG. 3A). Hereinbelow, the valve free-end 530 may refer to the free end portion of the valve 500, unless otherwise specified.

Although the contact between the valve edge 531 and the one surface 216 of the compression unit may cause noise, the noise is from line contact, which may be much smaller than noise caused by surface contact.

Specifically, the fastening portion 510 may be engaged with the one surface 216 of the compression unit by a fastening member 700 penetrating through the fastening portion 510, at a position apart from the discharge port 211. That is, the fastening portion 510 may be engaged with the top surface of the first plate part 215, at the position apart from the discharge port 211.

To maintain the first distance d1, a first spacing member 710 may be disposed between the fastening portion 510 and the one surface 216 of the compression unit. That is, the valve 500 may be spaced from the one surface 216 of the compression unit by the thickness of the first spacing member 710.

The fastening member 700 may penetrate through the fastening portion 510 and the first spacing member 710 and be fastened with the first plate part 215. The first spacing member 710 may be formed of a metal, resin, or rubber. For example, the first spacing member 710 may be a washer of a predetermined thickness.

Because the valve 500 has a stiffness, the valve 500 may be apart from the one surface 216 of the compression unit, along the whole length of the valve 500 by spacing the fastening portion 510 from the one surface 216 of the compression unit.

The valve 500 may extend from the fastening portion 510 toward the discharge port 211. The valve 500 may extend from the fastening portion 510 past the discharge port 211. That is, the discharge port 211 may be disposed between the fastening portion 510 and the valve free-end 530.

Specifically, the valve 500 may extend from the fastening portion 510 to the valve free-end 530 such that the valve 500 overlaps with the discharge port 211 over a part of the length of the valve 500. In other words, the valve 500, which is apart from the one surface 216 of the compression unit, may vertically overlap with the discharge port 211 over a part of the length of the valve 500. The partial length of the valve 500 may be large enough to cover the discharge port 211.

According to the present disclosure, when the valve 500 is closed, the valve edge 531 is bought into line contact with the one surface 216 of the compression unit, and then the discharge port 211 is closed, as described above. Therefore, the line contact may reduce noise, compared to surface contact.

The present disclosure may further include the retainer 600 which limits the opening displacement of the valve 500. The retainer 600 may be disposed above the valve 500, to limit a degree to which the valve 500 is opened. The retainer 600 may have a predetermined stiffness and elastically limit the opening degree of the valve 500.

For example, the stiffness of the retainer 600 may be larger than that of the valve 500. Therefore, the opening degree of the valve 500 may be limited by the retainer 600.

When the valve 500 is opened and brought into line contact first with the retainer 600, noise caused by collision between the valve 500 and the retainer 600 may be reduced.

The retainer 600 may be apart from the valve 500 along the whole length of the retainer 600 by a predetermined second distance d2. Like the valve 500, The valve 500 may include a fixing portion 610 fixed to one side 216 of the compression portion. The fixing portion 610 may be regarded as a fixed end of the retainer 600. The fastening portion 510 may be provided between the fixing portion 610 and the compression portion 200. That is, the fastening portion 510 and the fixing portion 610 may vertically overlap with each other and be fixed to the one surface 216 of the compression unit by the fastening member 700 penetrating through the fastening portion 5100 and the fixing portion 610.

Because the valve 500 and the retainer 600 are apart from each other, when the valve 500 is opened, collision noise between the valve 500 and the retainer 600 may from line contact, which is smaller than noise from surface contact.

Specifically, the retainer 600 may extend in parallel to the valve 500. That is, with the fluid compressor inoperative, the valve 500 and the retainer 600 may be parallel to each other.

Accordingly, when the valve 500 is opened, the valve free-end 530 may move for the second distance d2. In this state, the valve 500 and the retainer 600 may be brought into line contact.

The retainer 600 may be disposed overlapped with the valve 500 over the whole length of the retainer 600. That is, the retainer 600 and the valve 500 may extend in parallel in the same direction.

The length of the retainer 600 may be smaller than that of the valve 500. That is, the valve 500 may extend past a retainer free-end 630. The valve free-end 530 may be farther from the fastening member 700 than the retainer free-end 630.

For example, the retainer free-end 630, that is, the retainer free-end 630 may be placed above the top surface of the valve 500. In other words, a retainer edge 631 that is the edge of the retainer free end 630 may be disposed above the top surface of the valve 500, nearer to the fastening member 700 than the valve edge 531.

Therefore, as illustrated in FIG. 3B, when the valve 500 is opened, line contact between the valve 500 and the retainer 600 may cause noise. That is, when the valve 500 is opened, the top surface of the valve 500 may be brought into line contact with the retainer edge 631, thereby causing noise.

More specifically, the fastening portion 510 and the fixing portion 610 may be engaged with the one surface 216 of the compression unit by the single fastening member 700 penetrating through the fastening portion 510 and fixing portion 610, at a position apart from the discharge port 211.

To maintain the second distance d2, a second spacing member 720 may be disposed between the valve 500 and the retainer 600. That is, the second spacing member 720 may be disposed between the fastening portion 510 and the fixing portion 610.

The second spacing member 720 and the first spacing member 710 may be formed of the same material. The thickness of the second spacing member 720 may be equal to or different from that of the first spacing member 710. That is, the distance d2 may be equal to or different from the first distance d1.

Because the retainer 600 has a predetermined stiffness, the retainer 600 may be spaced from the valve 500 along the whole length of the retainer 600 by the second distance d2 by the second spacing member 720.

As described before, according to this embodiment, when the valve 500 repeats an opening and closing operation, noise is generated due to line contact between the valve 500 and the one surface 216 of the compression unit, and line contact between the valve 500 and the retainer 600.

The line contact-caused noise may be much smaller than surface contact-caused noise.

Now, a description will be given of the configurations of a valve and a retainer according to a second embodiment with reference to the other drawings.

Figure 4:
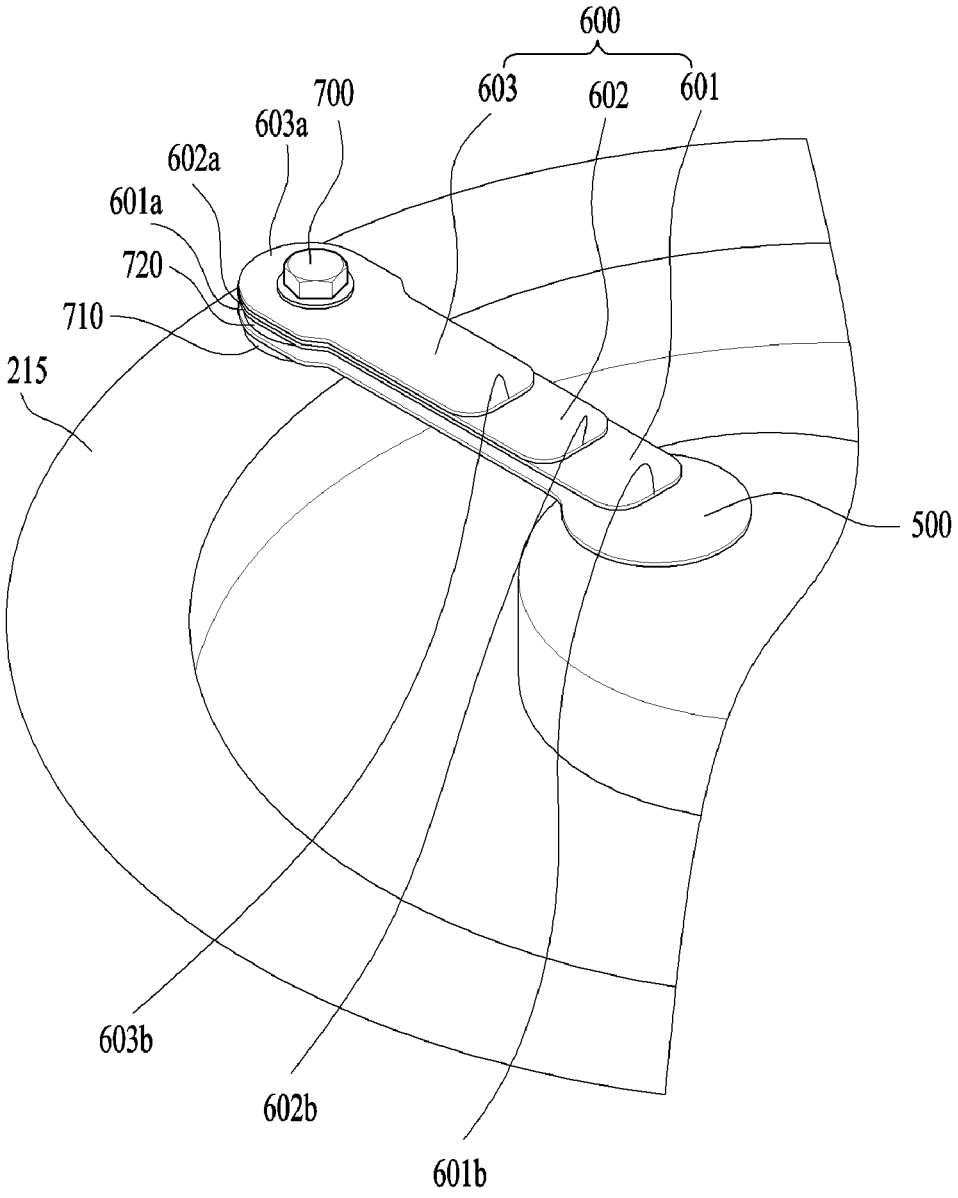
FIG. 4 is a perspective view illustrating a second embodiment of a valve for opening and closing a discharge port, and a retainer.
Figure 5:
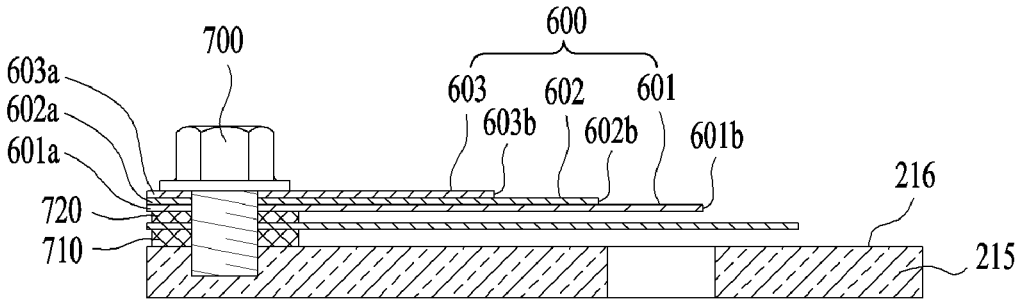
FIG. 5 is a side sectional view illustrating the valve and the retainer according to the second embodiment.

FIG. 4 is a perspective view illustrating a second embodiment of a valve for opening and closing a discharge port, and a retainer, and FIG. 5 is a side sectional view illustrating the valve and the retainer according to the second embodiment.

The following description is given of the configurations of the valve and the retainer according to the second embodiment, focusing on the difference from the first embodiment described with reference to FIGS. 2 to 3B, while a redundant description of the same structure as in the first embodiment is avoided.

The valve 500 of this embodiment may be identical to the valve 500 of the afore-described first embodiment. Further, as in the first embodiment, the valve 500 and the retainer 600 may be arranged in parallel, apart from each other.

According to this embodiment, the retainer 600 may have a different configuration from in the first embodiment.

Referring to FIGS. 4 and 5, compared to the first embodiment in which the retainer 600 includes a single plate, the retainer 600 may include a plurality of plates 601, 602 and 603 in the second embodiment.

In this embodiment, the retainer 600 may be formed as be a stack of the plurality of plates 601, 602, and 603. One lengthwise end portion of each of the plates 601, 602, and 603 together with the valve 500 may be engaged with the first plate part 215 by means of the single fastening member 700 as in the first embodiment.

Therefore, when the valve 500 is opened, damping efficiency may be increased by the retainer 600 including the plurality of plates 601, 602, and 603.

To reduce collision noise from each of the plates 601, 602, and 603 during repeated opening and closing of the valve 500, the plates 601, 602, and 603 may be formed to different lengths.

The plates 601, 602, and 603 may be formed such that a plate farther from the valve 500 is shorter.

In the illustrated embodiment, the plurality of plates 601, 602, and 603 may be three plates. Among the plurality of plates 601, 602, and 603, a first plate 601 (nearest to the valve 500) may be longest, and an exposure plate 603 (farthest from the valve 500) may be shortest.

A second plate 602 may be shorter than the first plate 601 and longer than the exposure plate 603.

Specifically, the free end portion of a plate relatively far from the valve 500 may be disposed on the top surface of a plate relatively near to the valve 500 in every two adjacent ones of the plurality of plates 601, 602, and 603.

In other words, as the free end portion of each of the plurality of plates 601, 602, and 603 is farther from the valve 500, the free end portion may be located nearer to the fastening member 700. The fixed ends of the plurality of plates may be arranged to overlap with each other, and the free ends of the plurality of plates may be disposed apart from each other. Specifically, the fixed end 601*a* of the first plate, the fixed end 602*a* of the second plate, and the fixed end 603*a* of the exposure plate may overlap each other and be coupled to the coupling member 700. The free end 601*b* of the first plate, the free end 602*b* of the second plate, and the free end 603*b* of the exposure plate may be spaced apart from each other.

Accordingly, the bottom edge of the free end portion of the relatively high plate and the top surface of the relatively low plate in every two adjacent ones of the plurality of plates 601, 602, and 603 may be brought into line contact during repeated opening and closing of the valve 500. Noise caused by the line contact may be smaller than noise caused by surface contact.

The plurality of plates 601, 602, and 603 may have the same or different stiffnesses. The stiffness of each of the plurality of plates 601, 602, and 603 may be smaller than that of the retainer formed to be a single plate in the first embodiment. However, the sum of the stiffnesses of the plurality of plates 601, 602, and 603 may be equal to or larger than the stiffness of the retainer in the first embodiment.

In this embodiment, the plurality of plates 601, 602, and 603 preferably have different stiffnesses. For example, as a plate is farther from the valve 500, the plate may be formed as a larger-stiffness member in the plurality of plates 601, 602, and 603.

That is, in the illustrated embodiment, the stiffness of a relatively high plate has a larger stiffness than a relatively low plate in the plurality of plates 601, 602, and 603. The different stiffnesses of the plurality of plates 601, 602, and 603 may lead to improved damping efficiency of the retainer 600.

As is apparent from the foregoing description, according to the present disclosure, a fluid compressor may be provided, which reduces noise by bringing a free end portion of a valve and one surface of a compression unit into line contact during opening and closing of the valve.

Further, according to the present disclosure, a fluid compressor may be provided, which reduces noise by bringing a valve and a retainer which limits the displacement of the valve into line contact during opening and closing of the valve.

Further, according to the present disclosure, a fluid compressor may be provided, which secures damping force and reduces noise by means of a retainer formed as a stack of a plurality of plates.

While preferred embodiments have been described for illustrative purposes, it will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A fluid compressor comprising:

a case comprising an inlet configured to receive and direct fluid to an inside of the case;

a compression unit that defines a compression chamber configured to compress the fluid in the case and a discharge port configured to discharge compressed fluid to an outside of the compression chamber;

a motor disposed inside the case and configured to drive the compression unit; and a valve coupled to the compression unit and configured to open and close at least a portion of the discharge port, wherein the valve comprises a fastening portion coupled to the compression unit and spaced apart from the discharge port by a first distance, the fastening portion having a coupling portion coupled to a surface of the compression unit, wherein the fluid compressor further comprises:

a retainer configured to limit a displacement of the valve based on the valve opening the discharge port, the retainer comprising a fixing portion coupled to the compression unit and spaced apart from the valve by a second distance, a first spacing member disposed between the coupling portion and the surface of the compression unit and configured to maintain the first distance between the valve and the compression unit, and a second spacing member disposed between the fastening portion of the valve and the fixing portion of the retainer and configured to maintain the second distance between the valve and the retainer, and wherein the valve has a lower surface that contacts the first spacing member and an upper surface that contacts the second spacing member.

2. The fluid compressor according to claim 1, wherein the valve has a free end that extends from the coupling portion toward the discharge port to thereby overlap with the discharge port.

3. The fluid compressor according to claim 1, wherein the retainer extends in a direction parallel to the valve.

4. The fluid compressor according to claim 3, wherein the retainer overlaps with the valve over an entire length of the retainer.

5. The fluid compressor according to claim 3, wherein a length of the retainer is less than a length of the valve.

6. The fluid compressor according to claim 3, wherein the fastening portion and the fixing portion are coupled to the surface of the compression unit by a fastening member that penetrates an end portion of each of the valve and the retainer, the end portion being disposed away from the discharge port.

7. The fluid compressor according to claim 3, wherein the retainer comprises a first end portion that has a free-end disposed vertically above a top surface of the valve and a second end portion that is coupled to the compression unit.

8. The fluid compressor according to claim 3, wherein the retainer comprises a plurality of plates that are stacked.

9. The fluid compressor according to claim 8, wherein lengths of the plurality of plates toward the discharge port decrease as distances between the compression unit and the plurality of plates increase.

10. The fluid compressor according to claim 9, wherein the plurality of plates comprise fixed ends that overlap with one another and free ends that are spaced apart from one another.

11. The fluid compressor according to claim 8, wherein stiffnesses of the plurality of plates are different from one another.

12. The fluid compressor according to claim 11, wherein the stiffnesses of the plurality of plates increase as distances between the valve and the plurality of plates increase.

13. The fluid compressor according to claim 8, wherein the plurality of plates comprise:

a first plate that is disposed vertically above the upper surface of the valve and that extends toward the discharge port; and a second plate that is disposed vertically above the first plate and that extends toward the discharge port, and wherein a length of the second plate toward the discharge port is less than a length of the first plate toward the discharge port.

14. The fluid compressor according to claim 13, wherein a first stiffness of the first plate is less than a second stiffness of the second plate.

15. The fluid compressor according to claim 14, wherein a sum of the first stiffness and the second stiffness is greater than or equal to a stiffness of the retainer.

16. The fluid compressor according to claim 13, wherein an upper surface of the first plate contacts a lower surface of the second plate.

17. The fluid compressor according to claim 1, wherein the compression unit comprises:

a fixed scroll comprising a first plate part and a first scroll that protrudes from a surface of the first plate part; and an orbiting scroll configured to be driven by the motor, the orbiting scroll comprising a second plate part and a second scroll that protrudes from a surface of the second plate part and that is meshed with the first scroll, and wherein the discharge port is defined in the first plate part.

18. The fluid compressor according to claim 1, wherein a length of the first spacing member and a length of the second spacing member are less than a length of the valve.

19. The fluid compressor according to claim 18, wherein a length of the retainer is greater than the length of the first spacing member and the length of the second spacing member.

20. The fluid compressor according to claim 18, wherein the length of the first spacing member and the length of the second spacing member are less than a distance between the coupling portion and an inner end of the discharge port, and wherein the length of the valve is greater than a distance between the coupling portion and an outer end of the discharge port.

* * * * *